US005905010A

United States Patent [19]

Nakamura et al.

[11] Patent Number: 5,905,010

[45] Date of Patent: May 18, 1999

[54] NONMAGNETIC TONER FOR FORMING FULL COLOR IMAGES

[75] Inventors: Minoru Nakamura, Itami; Masahiro Anno, Sakai; Chikara Tsutsui, Nishinomiya; Katsunori Kurose, Amagasaki, all of Japan

[73] Assignee: Minolta Co., Ltd., Osaka, Japan

[21] Appl. No.: 08/980,866

[22] Filed: Dec. 1, 1997

[30] Foreign Application Priority Data

Dec. 2, 1996 [JP] Japan ..... 8-321906

[51] Int. Cl.[6] ..... G03G 9/097

[52] U.S. Cl. ..... 430/110; 399/226; 430/903

[58] Field of Search ..... 430/110, 111, 430/903; 399/226

[56] References Cited

U.S. PATENT DOCUMENTS 5,176,978 1/1993 Kumashiro et al. ..... 430/110
5,424,162 6/1995 Kohri et al. ..... 430/110
5,439,772 8/1995 Takagi et al. ..... 430/106.6
5,486,445 1/1996 Van Dusen et al. ..... 430/110
5,759,732 6/1998 Nakamura et al. ..... 430/110

*Primary Examiner*—John Goodrow
*Attorney, Agent, or Firm*—McDermott, Will & Emery

[57] ABSTRACT

The nonmagnetic toner for forming full color images of the present invention comprises:

a binder resin, a colorant and wax dispersed in the binder resin as wax particles;

wherein the wax particles contained in the toner have a particle size distribution in which the wax particles having a particle size of 3 μm or more are less than 3% by number, the wax particles having a particle size ranging from 2 μm to less than 3 μm are less than 12% by number, the wax particles having a particle size ranging from 1 μm to less than 2 μm are 5% to 30% by number, and the wax particles having a particle size of less than 1 μm are 55% to 95% by number.

20 Claims, 2 Drawing Sheets

NONMAGNETIC TONER FOR FORMING FULL COLOR IMAGES

BACKGROUND OF THE INVENTION

1. Field of the Invention

The present invention relates to a nonmagnetic toner for forming full color images, and specifically relates to a nonmagnetic toner for developing electrostatic latent images in full color image forming apparatuses such as full color electrostatic type copiers, full color laser beam printers and the like.

2. Description of the Related Art

Conventionally, when fixing a toner image on a transfer sheet by means of a contact type heat-fixing method such as a heating roller fixing method or belt fixing method, a disadvantage arises in that during development toner is melted and transferred to a fixing roller, fixing belt or the like via contact therewith, and the transferred toner is thereafter re-adhered to a transfer sheet causing image noise (offset phenomenon).

The inclusion of wax such as low molecular weight polypropylene in the toner is a known art for preventing offset phenomenon but this practice produces further disadvantages described below when this art is applied to toner used in full color image forming apparatuses.

For example, when forming full color images using a full color laser beam printer, it is necessary to reduce the dot size for high resolution color image reproduction, and the variable density of the colors of the full color image are reproduced by changing the dot surface ratio per unit surface area. When forming an image of a pale color having a low dot surface area ratio (i.e., an image formed of separate dots), diffused reflection caused by said dots reduces light transmittancy and color reproducibility and becomes markedly problematic as dot size becomes smaller compared to images of deep colors having a high dot surface area ratio (image formed of continuous dots). This problem becomes even more pronounced when wax is added to the toner, and markedly reduced color reproducibility of pale colors when forming images on overhead projector transparencies (hereinafter referred to as "OHP film"). The addition of wax to the toner also causes new disadvantages such as filming on the photosensitive member.

Full color image forming apparatuses of compact design have been studied in recent years, and require ever more compact developing devices. In full color image forming apparatuses, four developing devices are required to respectively accommodate cyan developer, yellow developer magenta developer, and black developer. Nonmagnetic monocomponent developing devices which do not require a mixing mechanism to mix the toner and carrier are particularly advantageous when reducing the size of the developing device, but in the case of nonmagnetic monocomponent developing devices there is a disadvantage of toner readily adhering to the developer carrying member and developer regulating member. This problem of undesirable toner adhesion is particularly pronounced in toners used for full color developing which employ binder resin having sharp melt characteristics during fixing which are necessary for light transmittancy.

SUMMARY OF THE INVENTION

An object of the present invention is to provide a nonmagnetic toner having excellent anti-offset characteristics and light transmittancy and which eliminates the disadvantage of filming of the photosensitive member.

Another object of the present invention is to provide a nonmagnetic toner having excellent color reproducibility even when reproducing images having low dot surface area ratios.

Still another object of the present invention is to provide a nonmagnetic toner which eliminates the problem of toner adhesion on the developer carrying member and developer regulating member when using a nonmagnetic monocomponent developing method.

The nonmagnetic toner for forming full color images of the present invention comprises:

a binder resin, a colorant and wax dispersed in the binder resin as wax particles;

wherein the wax particles contained in the toner have a particle size distribution in which the wax particles having a particle size of 3 μm or more are less than 3% by number, the wax particles having a particle size ranging from 2 μm to less than 3 μm are less than 12% by number, the wax particles having a particle size ranging from 1 μm to less than 2 μm are 5% to 30% by number, and the wax particles having a particle size of less than 1 μm are 55% to 95% by number.

DESCRIPTION OF THE PREFERRED EMBODIMENTS

Figure 1:
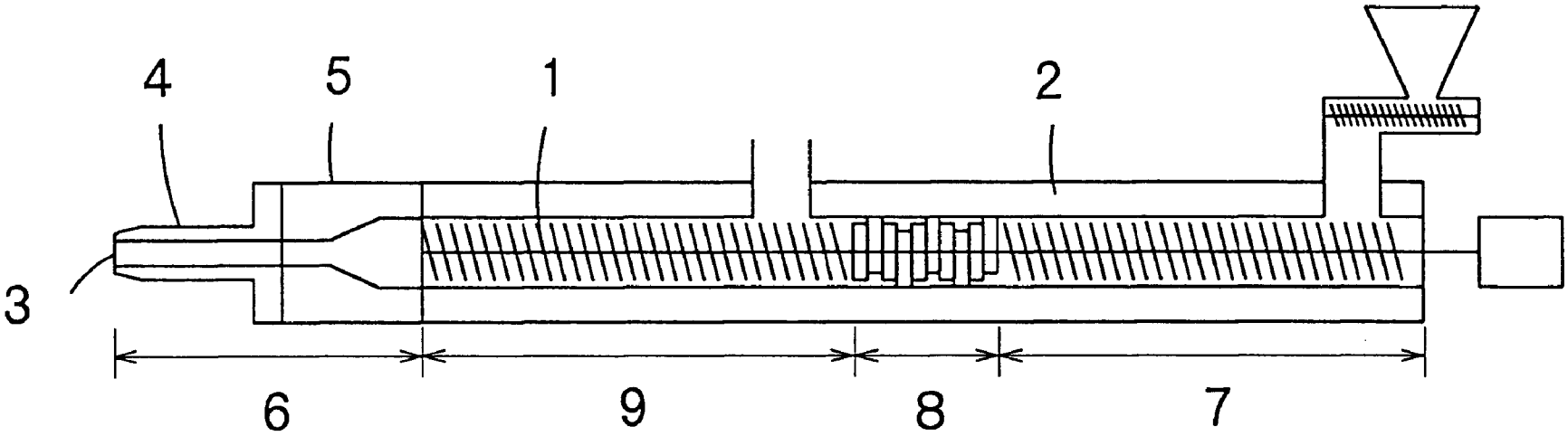
FIG. 1 briefly illustrates an extrusion kneading device.

The particle distribution of wax particles contained in the toner of the present invention has the wax particles which have a particle size of 3 μm or more being less than 3% by number, the wax particles which have a particle size ranging from 2 μm to less than 3 μm being less than 12% by number, the wax particles which have a particle size ranging from 1 μm to less than 2 μm being 5% to 30% by number, and the wax particles which have a particle size of less than 1 μm being 55% to 95% by number. Toner anti-offset characteristics can be improved without reducing color reproducibility or OHP transmittancy of image with low dot surface area ratios caused by small diameter dots by including in the toner a dispersion of wax particles having the aforesaid particle size distribution. That is, since large size wax particles are the cause of impaired light transmittancy and color reproducibility particularly in images having a low dot surface area ratio, whereas a dispersion of all fine wax particles reduces effectiveness in improving anti-offset characteristics, the toner of the present invention contains wax particles of the aforesaid specific particle size distribution. This wax particle size distribution eliminates the problem of filming of the photosensitive member. Large size wax particles released from the toner particles by the pulverization process during manufacture are mixed with the toner particles and are not removed by fine classification because of the small size difference relative to toner particles, and it is believed that these particles cause filming.

In other words, OHP transmittancy and color reproducibility are reduced when wax particle of 3 μm or more exceed 3% by number and wax particles ranging from 2 μm to less than 3 μm exceed 12% by number of the wax content. Furthermore, toner adhesion on the developer carrying member and developer regulating member readily occurs when wax particles less than 1 μm exceed 95% by number.

The desired particle size distribution of wax particles in the toner of the present invention has the wax particles which have a particle size of 5 μm or more being an actual 0% by number and the wax particles which have a particle size ranging from 3 μm to less than 5 μm being less than 3% by number. The more desired particle size distribution of wax particles in the toner of the present invention has the wax particles which have a particle size of 4 μm or more being an actual 0% by number and the wax particles which have a particle size ranging from 3 μm to less than 4 μm being less than 3% by number, and preferably less than 2% by number. It is further desirable to have the wax particles which have the particle size ranging from 2 μm to less than 3 μm being less than 10% by number, and preferably less than 8% by number, the wax particles which have the particle size ranging from 1 μm to less than 2 μm being 5% to 27% by number, and preferably 7% to 27% by number, and the wax particles which have the particle size of less than 1 μm being 60% to 95% by number, and preferably 60% to 90% by number.

The particle size distribution of wax particles contained in the toner of the present invention is measured by dissolving toner in an organic solvent capable of dissolving binder resin such as chloroform or the like, and centrifuging the solution to collect the free wax particles which are then photographed by electron microscopy and measuring the wax particle size distribution from said photographic image. For example, a photographic image of wax particles can be input in an image analyzer (Luzex model 5000; Nippon Regulator, Ltd.) used for scanning type electron microscopy photography to calculate the particle size distribution. The particle size of wax particles in the present invention is specified as the wax particle size determined by measuring the maximum size of wax particles when said wax particles are not completely spherical.

Methods of measuring the particle size of wax particles in addition to the aforesaid method include transmission electron microscopy (TEM) using a section of toner particle sectioned by a microtome. This method is undesirable, however, insofar as the measured particle size of wax particles may differ by an extremely small value from the actual particle of the wax particles contained in the toner. The reason for this discrepancy is that the measured wax particle size is completely different when measured at the center of a section of wax particle concentration and when measured at the edge of a section removed from the center of wax particle concentration even, for example, when measuring spherical wax particles of the same particle because this method measures the wax particle size in a cut section of the toner particle. There are also marked differences due to displacement of measured particle size caused by different section directions and section areas when the wax particle has a rugby ball-like shape.

In the present invention, usable waxes will have a softening point of 110 to 160° C., and preferably 130 to 160° C., e.g., low molecular weight polypropylene, low molecular weight polyethylene, carnuba wax and the like. Particularly desirable waxes include oxidized polypropylene modified by acidic monomers such as maleic acid. When the wax softening point is less than 110° C., there is reduced effectiveness of improved high-temperature offset, and when the softening point is greater than 160° C., there is inadequate wax dispersion in the binder resin which leads to filming of the photosensitive member.

In the present invention, the wax content is desirably 0.5 to 5 parts-by-weight (hereinafter referred to as "pbw"), and preferably 1 to 3 pbw relative to 100 pbw of binder resin. When the wax content is less than 0.5 pbw, there is inadequate effectiveness in improving anti-offset characteristics and eliminating toner adhesion on the developing sleeve and developer regulating member; when the wax content exceeds 5 pbw, light transmittancy is reduced.

Binder resins used in the toner of the present invention must have specific melt characteristics to obtain excellent light transmittancy and color reproducibility when the aforesaid wax is dispersed in full color toner. Specifically, the melt viscosity at 100° C. shall be $5\times10^4$~$1\times10^6$ Poise, and the ratio of melt viscosity $V_1$ at 90° C. to melt viscosity $V_2$ at 100° C. ($V_1/V_2$) is 8 or greater, and preferably $V_1/V_2$=8 to 40. When a binder resin is used which has a ratio $V_1/V_2$ less than 8, inadequate light transmittancy and color reproducibility result from diffused reflection due to loss surface smoothness of the dot image when reproducing images having a low dot surface area ratio.

The type of binder resin is not restricted insofar as said binder resin has the aforesaid melt characteristics. Examples of usable binder resins include styrene-acrylic copolymer resins, polyester resin, and epoxy resin used individually or mixed. Among such resins, polyester resins are particularly desirable.

Colorants usable in the toner of the present invention are not particularly limited inasmuch as well known dyes and pigments may be used. That is chromatic color dyes and pigments may be used for color toners of cyan, magenta, and yellow, and carbon black is desirable for use in black toner.

Colorants used on color toners will have improved colorant dispersibility if produced by master batch or flashing methods. Colorant content is desirably 2 to 15 pbw per 100 pbw binder resin.

Additional desirable additives to the toner of the present invention include charge controllers and the like.

Charge controllers are not specifically limited inasmuch as many well known charge controllers may be used. Charge controllers used in color toners should colorless, white, or very pale in color so as to not adversely affect light transmission. Examples of desirably colorants include salicylic acid metal complexes such as salicylic acid derivatives like zinc salicylate complex, calix arene compounds, organic boron compounds, quaternary ammonium salts containing fluorine. U.S. Pat. Nos. 4,206,064 and 4,762,763 disclose examples of usable salicylic acid metal complexes, U.S. Pat. No. 5,049,467 discloses examples of usable calix arene compounds, Japanese Laid-Open Patent Application No. 2-221967 discloses examples of usable organic boron compounds, and U.S. Pat. No. 5,069,994 discloses examples of usable quaternary ammonium salts containing fluorine.

When the aforesaid charge controller is added, the charge controller content is desirably 0.1 to 10 pbw, and preferably 0.5 to 5.0 pbw, relative to 100 pbw binder resin.

In the present invention, it is desirable to add to the exterior surface of the toner particles inorganic microparticles at a rate of 0.2 to 3 percent-by-weight (hereinafter referred to as "wt %") in the toner particles. Examples of usable inorganic microparticles include silica, titania, alumina, strontium-titanium oxide, tin oxide and the like subjected to surface processing by a hydrophobic agent, and used individually or on combinations of two or more. Additional materials other than the aforesaid inorganic oxides include resin microparticles of less than 1 μm to coat the exterior surface of the toner particles.

The toner of the present invention will desirably be regulated to a volume-average particle size of 4 to 10 μm, and preferably 5 to 9 μm, from the perspective of reproducibility of high resolution images.

The methods of manufacturing the toner of the present invention containing the aforesaid wax particles via kneading pulverization method are described below.

First, toner powder produced by a manufacturing process, binder resin, colorant, and wax, as well as additives such as charge controller, dispersion agent and the like as desired, are mixed in a mixing device such as a Henschel mixer or the like to adjust the mixture of the toner components. It is desirable to use master batch colorant as the colorant at this time.

Then, the adjusted mixture is fusion kneaded using an extrusion kneading device. Since a resin having the previously described specific melt viscosity characteristics is used as a binder resin at this time, fusion kneading should be accomplished by setting the temperature of the kneading device within a temperature range of the −20° C. of the resin softening point to +30° C. of the resin softening point. This temperature setting is necessary because adequate melting of the resin will not be accomplished if the temperature setting is too low, and if set too high, the melt viscosity of the resin is reduced during kneading such that adequate shearing force does not act on the kneaded material thereby preventing adequate dispersion of the wax among the fine particle size in the binder resin. The temperature of the kneaded material subjected to fusion kneading must be set to compensate for a potential 10~60° C. temperature rise above the set temperature induced by the influence of the shearing force and the like on the kneaded material.

When the kneaded material is removed from the extrusion kneading device, it is important to extract said material so as to not exert a larger pressure on the material during transport.

Normally, an extrusion kneading device is used which has an extrusion unit 6 comprising a nozzle unit 4 and head unit 5 as shown in FIG. 1 for fusion kneading the manufacturing of the toner. Usable extrusion kneading devices may have one shaft or two. The mixture of binder resin, colorant, and wax are supplied from a material inlet provided at one end of heating cylinder 2, and is fusion kneaded by transport unit 7 and kneading unit 8 via the rotation of paddles 1 driven by a motor. Paddles 1 may have two screws or three screws. The fusion kneaded material is transported through transport unit 9, and discharged from discharge port 3 of the discharge unit, and directly introduced into a press roller, cooled, and transported to the next pulverization process.

In the kneading device, the cross section area of the discharge unit 6, nozzle unit 4, and discharge port 3 of is markedly smaller than head unit 5 the empty cross section area of cylinder 2, such that fusion and kneading within kneading unit 8, and transport units 7 and 9 and the discharge pressure exerted by the discharge unit 6 on the wax within the toner components dispersed in small particle size re-flocculates so as to produce a large particle size and anomalous shape which adversely affects toner light transmittancy and filming characteristics.

According to the aforesaid conventional method, increasing the number of paddle rotations is effective in improving fine dispersion and mixing of the additives other than wax such as colorant, charge controller and the like, but wax dispersibility is reduced due to the increased discharge pressure. Furthermore, although the amount of added wax might be increased to improve toner anti-offset characteristics and anti-adhesion characteristics, this amount cannot be increased because it would quickly reduce the fine dispersibility due to the discharge pressure.

The aforesaid disadvantages can be eliminated by discharging from the extrusion kneading device the fusion kneaded material that has passed through the kneading unit so as to not produce a pressure greater than the pressure during transport. Specifically, the aforesaid materials can be fusion kneaded using an extrusion kneading device that does not have a nozzle or head unit. In this way, toner can be processed to have a uniform dispersion of wax particles in fine particle sizes because the fusion kneaded material is not subjected to a discharge pressure. According to this method, wax particles do not re-flocculate even when kneading is accomplished by increasing the number of paddle rotations of the kneading device, and wax particle re-flocculation does not occur even when the amount of added wax is increased.

When the kneaded material discharged from the extrusion kneading device is cooled, it is desirable to accomplish such cooling using a cold press roller, or when using a press roller to set the roller spacing wide for use in the subsequent pulverization process. When the press roller spacing is too narrow, the kneaded material is subjected to pressure during pressing which causes the wax particle size to increase under such pressure; therefore a roller spacing of 1 mm or more is desirable. The cooled kneaded material is coarsely pulverized, finely pulverized, and classified to produce the toner particles. The toner of the present invention may be used as a two-component developer including a carrier, or as a monocomponent developer without a carrier. From the perspective of compactness of the full color image forming apparatus, the toner of the present invention is particularly desirable for use in nonmagnetic developing methods which charge a toner by passing the toner past a regulating member in constructions a developer regulating member such as a flexible blade is pressed against a developer carrying member such as a developing sleeve.

Desirable carriers for use with the toner of the present invention in two-component developers include resin-coated carriers, for example, magnetic particles such as iron, magnetite, ferrite and the like coated with resin, or binder type carriers comprising magnetic powder dispersed in a binder resin. Examples of coated resins include silicone resin, organopolysiloxane and vinyl monomer copolymer resin (graft resins), resin coated carriers using polyester resin, and binder type carriers using styrene-acrylic resin, polyester resin or mixtures thereof as binder resin; these resins are desirable from the perspective of spent toner. A carrier having a volume-average particle size of 20~60 $\mu$m is desirable to prevent carrier adhesion and maintain high image quality.

The toner of the present invention is described hereinafter by way of specific examples, but it is to be understood that the present invention is not limited to the given examples.

EXAMPLE 1

Polyester resin (melt viscosity of $1\times10^5$ Poise at 100° C.; ratio of melt viscosity at 90° C./melt viscosity at 100° C. =9; softening point=98° C.) and cyan pigment (C.I. pigment blue 15-3) were introduced into a pressure kneader and kneaded to achieve a resin:pigment weight ratio of 7:3. The kneaded material was cooled, then pulverized in a feather mill, to obtain a master batch of pigment.

A mixture of 93 pbw of the aforesaid polyester resin, 10 pbw pigment master batch, 3 pbw low molecular weight polypropylene wax (Viscol TS200; softening point: 145° C.; Sanyo Kasei Kogyo), and 3 pbw zinc salicylate complex (E-84; Orient Chemical, Ltd.) as a negative charge controller was thoroughly mixed in a ball mill, then fusion kneaded at a set temperature of 110° C., paddle speed of 100 rpm, and feed rate of 5 kg/hr using a twin-shaft extrusion kneader (model PCM-30; Ikegai Tekkou K.K.) modified by removing the discharge unit. The kneaded material was subsequently pressed to a thickness of 2 mm by cold press roller and cooling belt, and the cooled material was coarsely pulverized by a feather mill, finely pulverized by a jet mill, and classified to obtain colored particles having a volume-average particle size of 8.0 μm. To 100 pbw of these colored particles was added 0.5 pbw hydrophobic silica (Taranox 500:Talco K.K.) to obtain toner A comprising said colored particles subjected to surface processing by hydrophobic silica.

EXAMPLE 2

Toner B treated by surface processing by hydrophobic silica was produced in the same manner as in Example 1 with the exception that 2 pbw low molecular weight polypropylene was added, and the set temperature of the twin-shaft extrusion kneader was 90° C. to obtain colored particles having a volume-average particle size of 8.2 μm.

EXAMPLE 3

Toner C treated by surface processing by hydrophobic silica was produced in the same manner as in Example 1 with the exception that 2 pbw low molecular weight polypropylene was added, and the set temperature of the twin-shaft extrusion kneader was 100° C. to obtain colored particles having a volume-average particle size of 8.0 μm.

EXAMPLE 4

Toner D treated by surface processing by hydrophobic silica was produced in the same manner as in Example 1 with the exception that the kneaded material was cooled by cold press roller to 1. 2 mm to obtain colored particles having a volume-average particle size of 8.0 μm.

EXAMPLE 5

Toner E treated by surface processing by hydrophobic silica was produced in the same manner as in Example 1 with the exception that polyester resin (melt viscosity=$1\times10^6$ Poise at 100° C., ratio of melt viscosity at 90° C./melt viscosity at 100° C.=15; softening point=109° C.) was used to obtain colored particles having a volume-average particle size of 8.5 μm.

COMPARATIVE EXAMPLE 1

Toner F treated by surface processing by hydrophobic silica was produced in the same manner as in Example 1 with the exception that low molecular weight polypropylene was not added to obtain colored particles having a volume-average particle size of 8.1 μm.

COMPARATIVE EXAMPLE 2

Toner G treated by surface processing by hydrophobic silica was produced in the same manner as in Example 1 with the exception that the set temperature of the twin-shaft extrusion kneader was 140° C. to obtain colored particles having a volume-average particle size of 8.2 μm.

COMPARATIVE EXAMPLE 3

Toner H treated by surface processing by hydrophobic silica was produced in the same manner as in Example 1 with the exception that the kneaded material was pressed to a thickness of 0.6 mm by cold press roller to obtain colored particles having a volume-average particle size of 8.1 μm.

COMPARATIVE EXAMPLE 4

Toner I treated by surface processing by hydrophobic silica was produced in the same manner as in Example 1 with the exception that kneading was accomplished by the twin-shaft extrusion kneader with the discharge nit installed to obtain colored particles having a volume-average particle size of 8.0 μm.

The aforesaid softening points and melt viscosities were measured using a flow tester (model CFT-500; Shimadzu) using a 1.0 g sample, 1.0×1.0 mm die, temperature rise speed of 3.0° C./min, preheating time of 180 sec, load of 30 kg, and measuring temperature range of 60~140° C. The temperature at which ½ extrusion was accomplished was designated the softening point.

Each toner was dissolved in chloroform, centrifuged, and the free wax was collected, and a photographic image of the wax particles was input to an image analyzer (Luzex 5000; Nippon Regulator, Ltd.) using a scanning electron microscope to measure the particle size distribution shown in Table 1. The size of particles was determined by measuring the maximum particle diameter when the wax particle was not completely spherical, and designated this value as the wax particle size.

TABLE 1

| | Wax Particle Size Distribution (%) | | | | | |
|---|---|---|---|---|---|---|
| | less than 1 μm | 1 μm or more but less than 2 μm | 2 μm or more but less than 3 μm | 3 μm or more but less than 5 μm | 5 μm or more | Maximum wax particle size |
| Ex 1 | 69.6 | 24.1 | 6.1 | 0.2 | 0 | 3.2 |
| Ex 2 | 93.1 | 5.5 | 1.4 | 0 | 0 | 2.5 |
| Ex 3 | 78.2 | 19.1 | 2.7 | 0 | 0 | 2.8 |
| Ex 4 | 65.3 | 23.1 | 10.5 | 1.1 | 0 | 3.5 |
| Ex 5 | 64.9 | 26.9 | 8.0 | 0.3 | 0 | 3.4 |
| CE 1 | — | — | — | — | — | — |
| CE 2 | 58.0 | 20.5 | 12.3 | 3.2 | 3.0 | 6.8 |
| CE 3 | 45.5 | 22.1 | 12.5 | 11.3 | 8.6 | 15.8 |
| CE 4 | 37.4 | 14.9 | 23.2 | 19.5 | 5.0 | 12.1 |

Each of the aforesaid toners were evaluated as described below. Evaluation results are shown in Table 2.

OHP Transmittancy and Color Reproducibility of Images having Different Dot Surface Area Ratios Images of 150 line screens having dot surface area ratios of 100%. 50%, and 20% were printed on an OHP transparency using the full color printer described below at a fixing temperature of 160° C. The image on the OHP sheet was projected and color was visually evaluated. Sharp color is indicated by the symbol ○, pale color is indicated by the symbol Δ, and no color is indicated by the symbol X.

Figure 2:
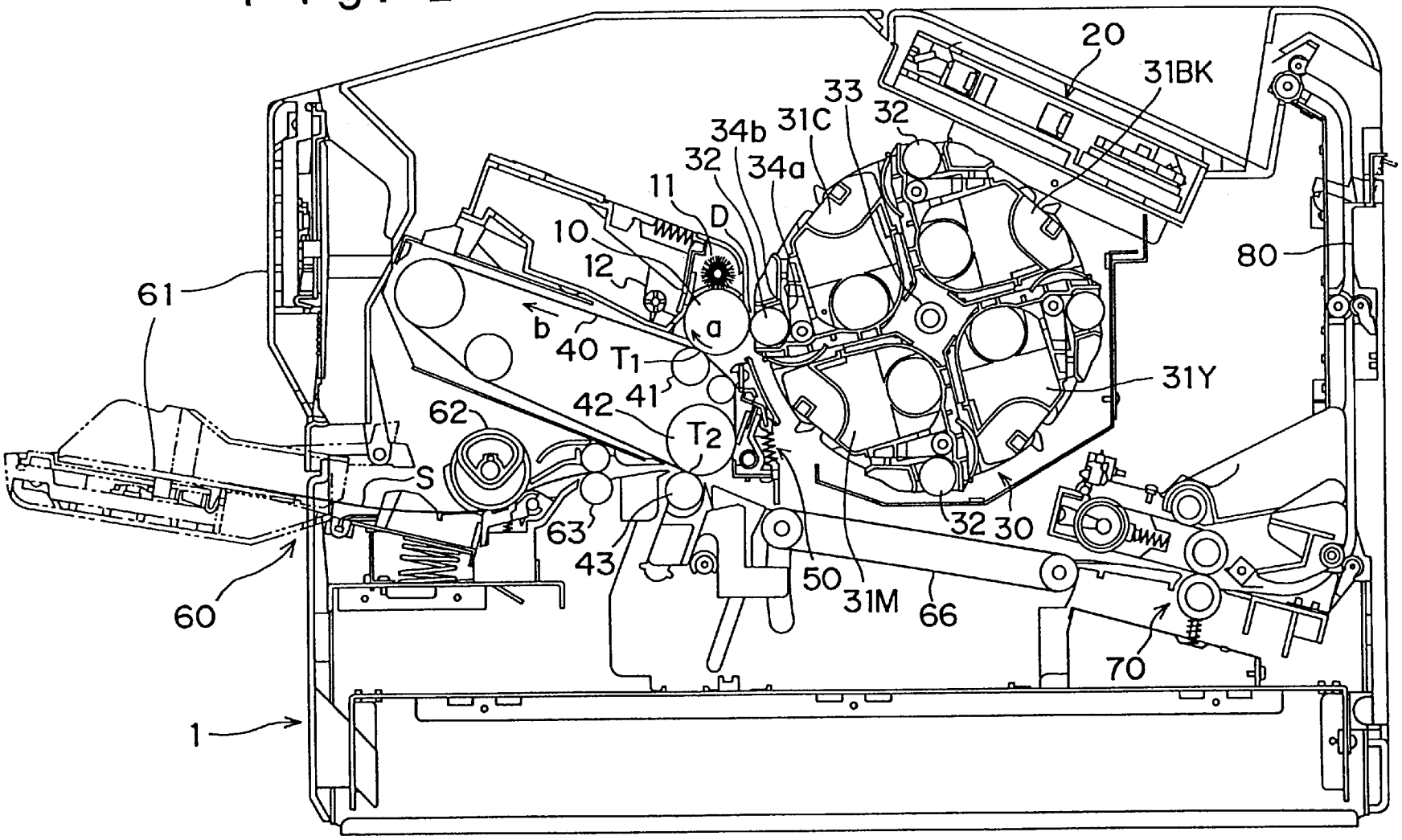
FIG. 2 briefly illustrates a full color printer.

The full color printer used in the evaluations is constructed as shown in FIG. 2, and comprises a photosensitive drum 10 (hereinafter referred to as "photosensitive member 10") rotated in the arrow a direction in the drawing, laser scanning unit 20, full color developing unit 30, endless type intermediate transfer belt 40 rotated in the arrow direction in the drawing, and paper supply unit 60. Arranged around the periphery of photosensitive member 10 are charging brush 11 to uniformly charge the surface of the photosensitive member 10 to a uniform potential, and cleaner 12 to remove residual toner form the surface of photosensitive member 10. Laser scanning unit 20 is a well known type provided with built in laser diodes, polygonal mirror, and fθ optical element, and the control unit receives image data of each color cyan (C), magenta (M), yellow (Y), and black (Bk) transmitted from a host computer. Laser scanning unit 20 sequentially outputs print data of each color as a laser beam to optically scan the surface of photosensitive member 10. Electrostatic latent images of each color are sequentially formed on the surface of photosensitive member 10 by the aforesaid process.

Full color developing unit 30 is integratedly provided with four color developing devices respectively accommodating monocomponent developer comprising a nonmagnetic toner of C, M, Y, or Bk, and the developing unit 30 is rotatable in a clockwise direction about a pivot point of shaft 33. Each developing device is provided with a developing sleeve 32, and toner regulating blades 34*a* and 34*b*. Toner transported via the rotation of developing sleeve 32 passes through a pressure area (regulating area) between blades 34*a* and 34*b* and the developing sleeve 32 so as to become charged thereby.

Intermediate transfer belt 40 is rotated in the arrow b direction in the drawing synchronously with the photosensitive member 10. Intermediate belt 40 is pressed by a rotatable primary transfer roller 41 so as to come into contact with photosensitive member 10. The contact area T1 is designated the primary transfer region. A rotatable secondary transfer roller 43 contacts the intermediate transfer belt 40 at an area supported by support roller 42. This contact area T2 is designated the secondary contact region.

A cleaner 50 is provided in the space between the aforesaid developing unit 30 and intermediate transfer belt 40. Cleaner 50 has a blade to remove the residual toner remaining on the surface of intermediate transfer belt 40. This blade and the secondary transfer roller 43 are retractable relative to the intermediate transfer belt 40.

Paper supply unit 60 comprises paper tray 61 openable on the front side of image forming apparatus 1, paper feed roller 62, and timing roller 63. Recording sheets S are stacked in paper tray 61 and are fed therefrom one sheet at a time in a rightward direction in the drawing via the rotation of feed roller 62, and are transported to the secondary transfer region synchronously with the image formed on intermediate transfer belt 40 via timing roller 63. The horizontal transport path of recording sheet S comprises an air suction belt 66 and includes the aforesaid paper supply unit, and a perpendicular transport path 80 is provided with a transport roller from fixing device 70. Recording sheet S is ejected from the perpendicular transport path 80 onto the top of the image forming apparatus.

The printing operation of the full color printer is described below. When a print operation starts, photosensitive member 10 and intermediate transfer belt 40 are driven in rotation at identical circumferential speed, and the surface of photosensitive member 10 is uniformly charged to a predetermined potential by charging brush 11.

Then, the surface of photosensitive member 10 is irradiated by laser scanning unit 20 to form an electrostatic latent image of a cyan color image thereon. This latent image is developed by developing device 31C, and the developed toner image is transferred onto the intermediate transfer belt 40 at the primary transfer region T1. Directly after the primary transfer ends, the developing unit is switched to developing device 31M at image region D, and a magenta image is exposed and latent image formed, said latent image is developed and transferred via primary transfer. Then, the developing device 31Y is selected, a yellow image is irradiated, developed and transferred via primary transfer. Finally back developing device 31Bk is selected, a black image is exposed, developed, and transferred via primary transfer, such that said toner images are overlaid one upon another on intermediate transfer belt 40 in the primary developing region.

Finally, when the primary transfer operation is completed, recording sheet S is transported to the secondary transfer region T2, and the full color toner image formed on intermediate transfer belt 40 is transferred onto said recording sheet S. When the secondary transfer operation ends, recording sheet S is transported to a belt type contact heat-fixing device 70, which fuses the full color toner image on recording sheet S, and said recording sheet S is thereupon ejected onto the top of printer body 1.

Anti-offset Characteristics

An electrophotographic printer provided with a nonmagnetic monocomponent developing device (model SP-1000; Minolta Co., Ltd.) was modified so as to allow adjustment of the fixing roller temperature. The temperature at which offset occurs was investigated by changing the set temperature of the fixing roller and printing. An offset temperature of 180° C. and higher is indicated by the symbol ◎, an offset temperature of 170° C. and higher but less than 180° C. is indicated by the symbol ○, an offset temperature of 160° C. and higher but less than 170° C. is indicated by the symbol Δ, and an offset temperature of less than 160° C. is indicated by the symbol X.

Adhesion Characteristics

Each toner was loaded in a developing device of the printer model SP-1000 from which the photosensitive member had been removed, and the developing sleeve was continuously rotated for 20 hr. The occurrence of toner adhesion on the developing sleeve and developer regulating member, and the occurrence of white streaks on the developing sleeve (i.e., the phenomenon of streak-like nonforming toner layer on the developing sleeve due to toner adhesion on the regulating member), were evaluated. Definite image noise is indicated by the symbol X, slight white streaks producing image noise that posed no practical problem is indicated by the symbol Δ, and no white streaks is indicated by the symbol ○.

Filming

The photosensitive member was visually examined and evaluated after printing 6,000 prints by the model SP-100 printer. A complete lack of filming is indicated by the symbol ○, slight filming that did not produce image noise is indicated by the symbol Δ, and definite filming that caused image noise is indicated by the symbol X.

TABLE 2

| | OHP transmittancy and color reproduction | | | Anti- | | |
|---|---|---|---|---|---|---|
| | 100% | 50% | 20% | offset | Filming | Adhesion |
| Ex 1 | ○ | ○ | ○ | ◎ | ○ | ○ |
| Ex 2 | ○ | ○ | ○ | ◎ | ○ | Δ |
| Ex 3 | ○ | ○ | ○ | ◎ | ○ | ○ |
| Ex 4 | ○ | ○ | Δ | ◎ | ○ | ○ |
| Ex 5 | ○ | ○ | ○ | ◎ | ○ | ○ |
| CE 1 | ○ | ○ | ○ | x | ○ | x |
| CE 2 | ○ | ○ | x | ◎ | Δ | ○ |
| CE 3 | ○ | Δ | x | ○ | x | Δ |
| CE 4 | ○ | Δ | x | ○ | x | Δ |

What is claimed is:

1. A nonmagnetic toner for forming full color images comprises:

a binder resin, a colorant and wax dispersed in the binder resin as wax particles;

wherein the wax particles contained in the toner have a particle size distribution in which the wax particles having a particle size of 3 μm or more are less than 3% by number, the wax particles having a particle size ranging from 2 μm to less than 3 μm are less than 12% by number, the wax particles having a particle size ranging from 1 μm to less than 2 μm are 5% to 30% by number, and the wax particles having a particle size of less than 1 μm are 55% to 95% by number.

2. The nonmagnetic toner of claim 1, wherein the wax particles have the particle size distribution in which the wax particles having a particle size of 5 μm or more are 0% by number, and the wax particles having a particle size ranging from 3 μm to less than 5 μm are less than 3% by number.

3. The nonmagnetic toner of claim 2, wherein the wax particles have the particle size distribution in which the wax particles having a particle size of 4 μm or more are 0% by number, and the wax particles having a particle size ranging from 3 μm to less than 4 μm are less than 3% by number.

4. The nonmagnetic toner of claim 1, wherein the wax particles have the particle size distribution in which the wax particles having the particle size ranging from 2 μm to less than 3 μm are less than 10% by number, the wax particles having the particle size ranging from 1 μm to less than 2 μm are 5% to 27% by number, and the wax particles having the particle size of less than 1 μm are 60% to 95% by number.

5. The nonmagnetic toner of claim 1, wherein the wax has a softening point of 110° C. to 160° C.

6. The nonmagnetic toner of claim 5, wherein an amount of the wax is from 0.5 to 5 parts by weight per 100 parts by weight of the binder resin.

7. The nonmagnetic toner of claim 6, wherein an amount of the wax is from 0.5 to 3 parts by weight per 100 parts by weight of the binder resin.

8. The nonmagnetic toner of claim 1, wherein the binder resin has a melt viscosity at 100° C. of $5\times10^4$ to $1\times10^6$ poise.

9. The nonmagnetic toner of claim 8, wherein the binder resin has a ratio of melt viscosity $V_1$ at 90° C. to melt viscosity $V_2$ at 100° C. ($V_1/V_2$) being 8 or more.

10. A monocomponent nonmagnetic toner for forming full color images comprises:

a binder resin, a colorant and wax dispersed in the binder resin as wax particles;

wherein the wax particles contained in the toner have a particle size distribution in which the wax particles having a particle size of 3 μm or more are less than 3% by number, the wax particles having a particle size ranging from 2 μm to less than 3 μm are less than 12% by number, the wax particles having a particle size ranging from 1 μm to less than 2 μm are 5% to 30% by number, and the wax particles having a particle size of less than 1 μm are 55% to 95% by number.

11. The monocomponent nonmagnetic toner of claim 10, wherein the wax particles have the particle size distribution in which the wax particles having the particle size ranging from 2 μm to less than 3 μm are less than 10% by number, the wax particles having the particle size ranging from 1 μm to less than 2 μm are 5% to 27% by number, and the wax particles having the particle size of less than 1 μm are 60% to 95% by number.

12. The monocomponent nonmagnetic toner of claim 10, wherein the wax has a softening point of 110° C. to 160° C.

13. The monocomponent nonmagnetic toner of claim 12, wherein an amount of the wax is from 0.5 to 5 parts by weight per 100 parts by weight of the binder resin.

14. The monocomponent nonmagnetic toner of claim 13, wherein an amount of the wax is from 0.5 to 3 parts by weight per 100 parts by weight of the binder resin.

15. The monocomponent nonmagnetic toner of claim 10, wherein the binder resin has a melt viscosity at 100° C. of $5\times10^4$ to $1\times10^6$ poise.

16. The monocomponent nonmagnetic toner of claim 15, wherein the binder resin has a ratio of melt viscosity $V_1$ at 90° C. to melt viscosity $V_2$ at 100° C. ($V_1/V_2$) being 8 or more.

17. A developing device for a full color image forming apparatus comprises:

a toner carrier member having an outer surface for retaining a nonmagnetic toner thereon and being provided rotatably;

a regulating member having a potion which contacts the toner carrier member so that the toner is regulated and then formed into a thin layer; and the toner comprising a binder resin, a colorant and wax dispersed in the binder resin as wax particles;

wherein the wax particles contained in the toner have a particle size distribution in which the wax particles having a particle size of 3 μm or more are less than 3% by number, the wax particles having a particle size ranging from 2 μm to less than 3 μm are less than 12% by number, the wax particles having a particle size ranging from 1 μm to less than 2 μm are 5% to 30% by number, and the wax particles having a particle size of less than 1 μm are 55% to 95% by number.

18. The developing device of claim 17, wherein said regulating member has a blade form.

19. The developing device of claim 17, wherein the wax has a softening point of 110° C. to 160° C., and an amount of the wax is from 0.5 to 5 parts by weight per 100 parts by weight of the binder resin.

20. The developing device of claim 17, wherein the binder resin has a melt viscosity at 100° C. of $5\times10^4$ to $1\times10^6$ poise, and has a ratio of melt viscosity $V_1$ at 90° C. to melt viscosity $V_2$ at 100° C. ($V_1/V_2$) being 8 or more.

* * * * *